US007002520B2

(12) United States Patent
Bae

(10) Patent No.: US 7,002,520 B2
(45) Date of Patent: Feb. 21, 2006

(54) WIDE BAND ANTENNA FOR MOBILE COMMUNICATION

(75) Inventor: Jung-Bin Bae, Kwangju (KR)

(73) Assignee: Antenna Tech, Inc., Guangju (KR)

( * ) Notice: Subject to any disclaimer, the term of this patent is extended or adjusted under 35 U.S.C. 154(b) by 0 days.

(21) Appl. No.: 10/474,532

(22) PCT Filed: Sep. 28, 2001

(86) PCT No.: PCT/KR01/01644

§ 371 (c)(1),
(2), (4) Date: Mar. 8, 2004

(87) PCT Pub. No.: WO02/084795

PCT Pub. Date: Oct. 24, 2002

(65) Prior Publication Data

US 2004/0145524 A1 Jul. 29, 2004

(30) Foreign Application Priority Data

Apr. 12, 2001 (KR) ..... 2001/19651

(51) Int. Cl.
*H01Q 1/24* (2006.01)

(52) U.S. Cl. ..... 343/702; 343/721; 343/860

(58) Field of Classification Search ..... 343/702, 343/700 MS, 721, 850, 860, 846; 455/90, 455/566, 575

See application file for complete search history.

(56) References Cited

U.S. PATENT DOCUMENTS

| | | | | |
|---|---|---|---|---|
| 4,673,832 A | 6/1987 | Murakami et al. | ..... | 307/326 |
| 4,697,189 A | 9/1987 | Ness | ..... | 343/700 MS |
| 5,703,600 A | 12/1997 | Burrell et al. | ..... | 343/700 MS |
| 6,150,984 A | 11/2000 | Suguro et al. | ..... | 343/702 |
| 6,438,391 B1 * | 8/2002 | Wang | ..... | 455/566 |
| 6,490,439 B1 * | 12/2002 | Croft et al. | ..... | 455/90.1 |

FOREIGN PATENT DOCUMENTS

| | | |
|---|---|---|
| JP | 02 222202 A | 9/1990 |
| JP | 11 225102 A | 8/1999 |
| KR | 1997-0006764 | 4/1997 |

OTHER PUBLICATIONS

C.L. Mak, et al. *Microstrip Line-Fed L-Strip Patch Antenna*; IEEE Proc: Micro.Antennas Propag. vol. 146, No. 4, Aug. 1999.

* cited by examiner

*Primary Examiner*—Hoang V. Nguyen
(74) *Attorney, Agent, or Firm*—Alston & Bird LLP

(57) ABSTRACT

Disclosed is a mobile communication wide band antenna that comprises a radio wave radiator for receiving transmission signals and power and radiating radio waves corresponding to the transmission signals; and an operating state display for receiving the radio waves radiated by the radio wave radiator and displaying operating states of the radio wave radiator according to the received radio waves. The radio wave radiator comprises a ground surface for functioning as ground; a radiation element supported by the ground surface to have a first gap from the ground surface and radiating the radio waves; and a microstrip feeder supported by the ground surface, having a second gap and a third gap from the ground surface, and for receiving the transmission signals and the power and having an electromagnetic coupling with the radiation element, the third gap being provided to be located between the ground surface and the radiation element.

16 Claims, 8 Drawing Sheets

WIDE BAND ANTENNA FOR MOBILE COMMUNICATION

This application is a 371 of PCT/KR01/01644 dated Sep. 28, 2001.

BACKGROUND OF THE INVENTION (a) Field of the Invention

The present invention relates to an antenna for mobile communication. More specifically, the present invention relates to a wide band antenna for mobile communication for providing wide band frequency features and enabling a user to easily distinguish normal radiation states of the antenna.

(b) Description of the Related Art

Various wireless communication services have become available in fields such as cellular phones and personal communication services (PCS), and the next generation mobile communication system, the IMT-2000 service, will be issued in the near future. Accordingly, more techniques for minimizing and reducing the weight of terminals or base station communication devices have been required.

Recent developments of additional functions such as wireless data communications mean that the conventional communication services have been lifted to a higher level from mere voice-centered communications. To use the plural communication services, plural antennas for the respective services must be installed. Therefore, mobile communication service providers build repeaters and small patch antennas each connected to the repeater in buildings so as to enable the mobile communication services in tall buildings or basements.

For example, cellular mobile communications of about 800 MHz frequency band and PCS communications of 1,800 MHz frequency band have been commercialized, and since these two communication methods use different frequency bands, the mobile communication service providers separately install respective cellular phone patch antennas and PCS patch antennas, and they will have to install IMT-2000 patch antennas in the near future.

FIG. 1 shows general mobile communication patch antennas.

As shown, the general mobile communication patch antennas are categorized as follows according to feeding methods: a microstrip feeder type patch antenna, a coaxial cable feeder type patch antenna and a slot coupling feeder type patch antenna.

The general mobile communication patch antenna comprises a dielectric substrate 10, a ground surface 13 and a metallic radiation element 11. FIG. 2 shows frequency characteristics of this patch antenna.

As the gap between the radiation element 11 and the ground surface 13 becomes greater and the dielectric constant of the dielectric substrate 10 becomes that of the air, effectiveness and bandwidth of the patch antenna are increased.

However, the general patch antenna shown in FIG. 1 has a restriction in the case of expanding the frequency bands, and when the dielectric substrate 10 is designed to have low dielectric constant, the design cost is increased because a thick and low dielectric constant substrate 10 generates high-order surface waves.

As described above, because of the bandwidth restriction caused by its structure, the general patch antenna cannot be a common use antenna for supporting various mobile communication services such as cellular phones, PCS and IMT-2000. Hence, respective antennas corresponding to the various services must be separately installed, and accordingly, this installation spoils the beauty of the interiors of buildings and generates excessive installation and maintenance costs.

Since a repeater installed in a building adopts a low power output method, a plurality of patch antennas must be installed on each floor of a building. In this case, a user cannot determine whether signal power is radiated from the installed patch antennas in the rated manner. In other words, the user cannot distinguish with the naked eye whether the patch antennas are normally operating. To check their operating states, the user must either check receipt power while the user is near the antenna using a terminal or measure the same using a spectrum analyzer, thereby causing inconvenience.

SUMMARY OF THE INVENTION

It is an object of the present invention to provide a mobile communication wide-band antenna for providing wide-band frequency characteristics and enabling a user to distinguish normal radiation states of the antenna with the naked eye.

In one aspect of the present invention, a mobile communication wide band antenna comprises a radio wave radiator for receiving transmission signals and power, and radiating radio waves corresponding to the transmission signals; and an operating state display for receiving the radio waves radiated by the radio wave radiator and displaying operating states of the radio wave radiator according to the received radio waves. The radio wave radiator comprises a ground surface for functioning as ground; a radiation element supported by the ground surface having a first gap from the ground surface and radiating the radio waves; and a microstrip feeder supported by the ground surface, having a second gap and a third gap from the ground surface, and for receiving the transmission signals and the power and having an electromagnetic coupling with the radiation element, the third gap being located between the ground surface and the radiation element.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 3:
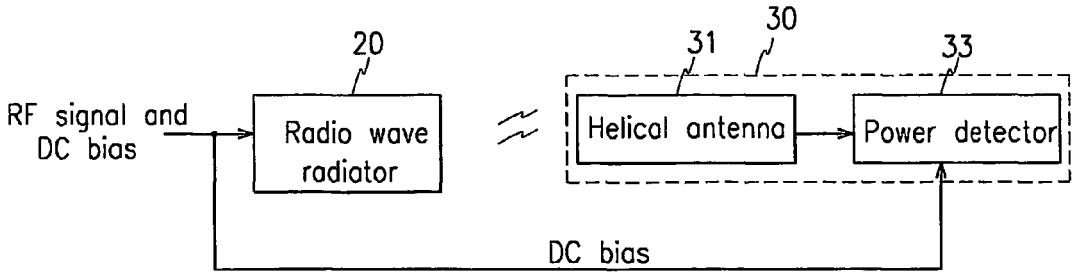
FIG. 3 shows a block diagram of a mobile communication wide-band antenna according to a first preferred embodiment of the present invention.

FIG. 3 shows a block diagram of a mobile communication wide-band antenna according to a first preferred embodiment of the present invention.

As shown, the mobile communication wide-band antenna comprises a radio wave radiator 20 for receiving radio frequency (RF) signals and direct current (DC) bias and radiating corresponding radio waves; and an operating state display 30 for receiving the radio waves radiated by the radio wave radiator 20 and displaying operating states of the radio wave radiator 20.

A configuration and operation of the radio wave radiator 20 will now be described.

Figure 4A:
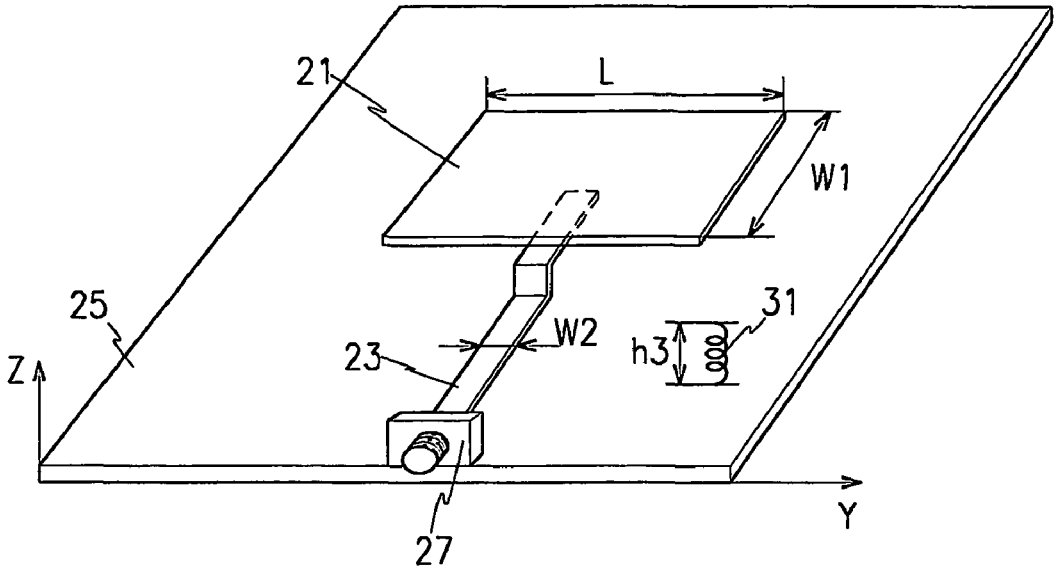
FIGS. 4(*a*) and (*b*) respectively show a radio wave radiator 20 of the mobile communication wide-band antenna of FIG. 3.
Figure 4B:
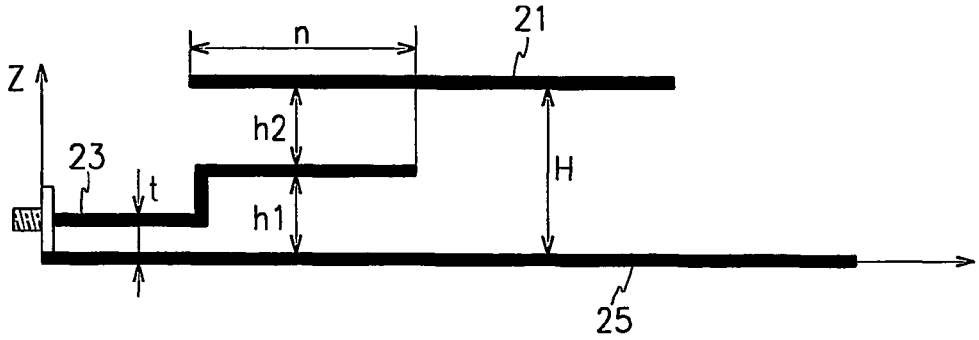

FIGS. 4(*a*) and (*b*) respectively show a radio wave radiator 20 of the mobile communication wide-band antenna of FIG. 3. Here, FIG. 4(*a*) shows an angular perspective view of the radio wave radiator 20, and FIG. 4(*b*) shows a cross sectional view of the radio wave radiator 20.

As shown, the radio wave radiator 20 comprises a radiation element 21 of a metallic conductive substrate with a thickness of 0.3 mm to 0.5 mm; an air microstrip feeder 23 of a metallic conductive substrate with a thickness of 0.3 mm to 0.5 mm; a ground surface 25; and a connector 27.

The radiation element 21 and the air microstrip feeder 23 are supported by the ground surface 25.

The characteristic impedance of the air microstrip feeder 23 must be 50 Ω so as to perform impedance matching, and the characteristic impedance is obtained by setting the gap "t" between the width $W_2$ of the air microstrip feeder 23 and the ground surface 25.

The gap "t" is found as follows:

$$\frac{W_2}{t} = \frac{2}{\pi}\cdot\left\{B-1-\ln(2B-1)+\frac{\varepsilon_r-1}{2\varepsilon_r}\cdot\left[\ln(B-1)+0.39-\frac{0.61}{\varepsilon_r}\right]\right\} \quad \text{Equation 1}$$

in the case of $\frac{W_2}{t} \geq 2$, and $$\frac{W_2}{t} = \frac{8\exp(A)}{\exp(2A)-2} \text{ in the case of } \frac{W_2}{t} \leq 2, \text{ where}$$

$$A = \frac{Z_0}{60}\cdot\left\{\frac{\varepsilon_r+1}{2}\right\}^{\frac{1}{2}} + \frac{\varepsilon_r-1}{\varepsilon_r+1}\cdot\left\{0.23+\frac{0.11}{\varepsilon_r}\right\},\ B = \frac{60\pi^2}{Z_0\sqrt{\varepsilon_r}},$$

$Z_0$ represents the characteristic impedance of the air microstrip feeder 23, that is, 50 Ω, and $\epsilon_r$ represents the dielectric constant between the radiation element 21 and the ground surface 25.

The air microstrip feeder 23 reaches to about a central portion on the radiation element 21 between the radiation element 21 and the ground surface 25. The more the reaching distance "n" is increased, the more an electromagnetic coupling is increased. The connector 27 is connected to the air microstrip feeder 23 so as to provide a communication signal tube.

The air microstrip feeder 23 is formed to be bent into an L shape so that a gap H between the radiation element 21 and the ground surface 25 is divided into gaps "h1" and "h2." The gap "h1" represents a distance between the air microstrip feeder 23 and the ground surface 25, and the gap "h2" shows a distance between the air microstrip feeder 23 and the radiation element 21.

The bandwidth of the mobile communication wide-band antenna is greater than 420 MHz so as to be commonly used with the PCS service of 1,750 to 1,870 MHz frequencies and the IMT-2000 service of 1,920 to 2,170 MHz frequencies, and the dimensions L, W1, H, h1 and h2 of the radiation element 21 for achieving the above-noted wide bands can be obtained by complicated computation equations.

It is preferable to define the above-described dimensions based on central frequencies of the whole frequency bands including the PCS and IMT-2000 service frequency bands.

Experimentally, it is reported that the mobile communication wide-band antenna is most effective in receipt of frequency band of the PCS service among the central frequencies, that is, 1.840 GHz, and in the case the wavelength λ of the reference frequency is set as a reference, the dimensions L and W1 of the radiation element are set to be about λ/2, the gap H to be about λ/8, and a gap h3 to be about (0.7×H). Regarding experimentally found values to be commonly used for the PCS and the IMT-2000 services, the dimensions L×W1 of the radiation element is 85.8 mm×81.8 mm, the gap h1 is about 12 mm, the gap h2 is 8.2 mm, and the gap H is 20.2 mm.

Figure 5:
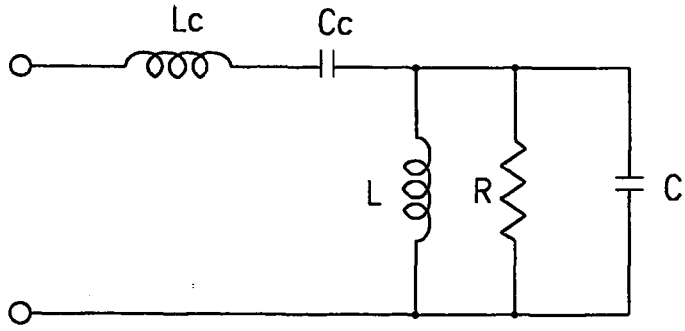
FIG. 5 shows an equivalent circuit of a radiation element including a feeder in the mobile communication wide-band antenna of FIG. 3.

The radiation element 21 and the air microstrip feeder 23 described above can be shown as an equivalent circuit as depicted in FIG. 5.

Figure 1:
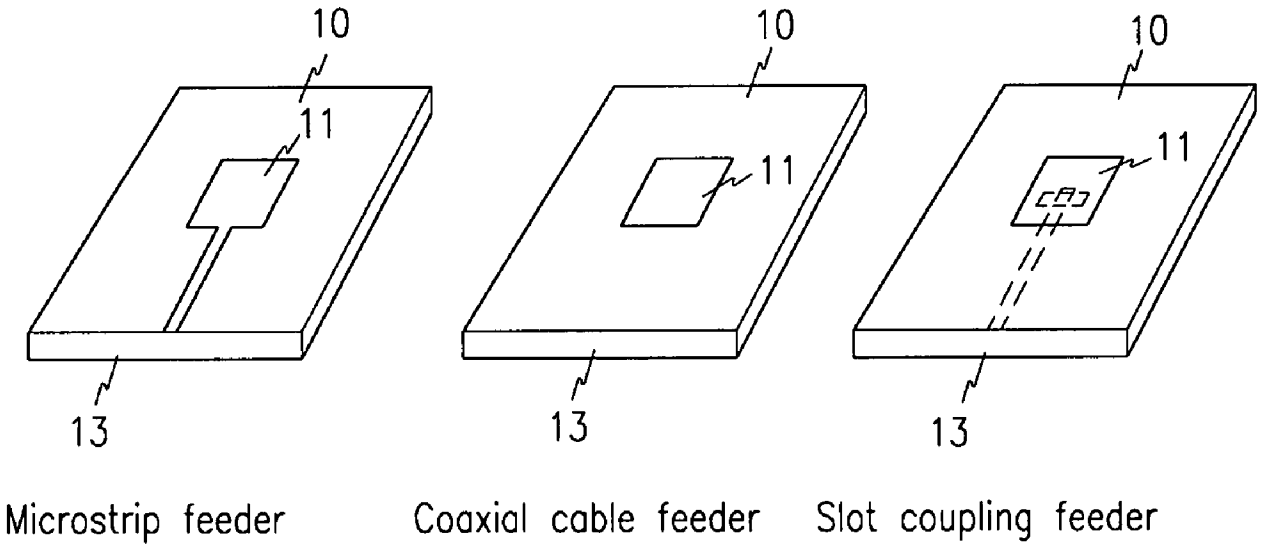
FIG.1 (Prior Art)
FIG. 1 shows a general mobile communication patch antenna.

The feeder of the general antenna as illustrated in FIG. 1 generates the inductance $L_C$ to worsen the characteristics of the antenna, and the feeder cannot have the wide-band frequency characteristics because of the worsened characteristics. However, the feeder as shown in FIG. 5 according to the present invention induces the capacitance $C_C$ at the horizontal portion of the L-shaped air microstrip feeder 23 so as to compensate for the inductance $L_C$ induced at the perpendicular portion, and the capacitance $C_C$ and the inductance $L_C$ are formed as a serial L-C structure so that the feeder is resonated, thereby forming a double resonance structure because of the above-described resonance and the resonance generated by the radiation element 21. Since this resonance structure has different resonance modes at mutually approaching frequencies, the bandwidths to be wholly used by the antenna are improved. Therefore, the operation of the wide-band antenna that includes the PCS and IMT-2000 service frequencies is enabled.

Figure 2:
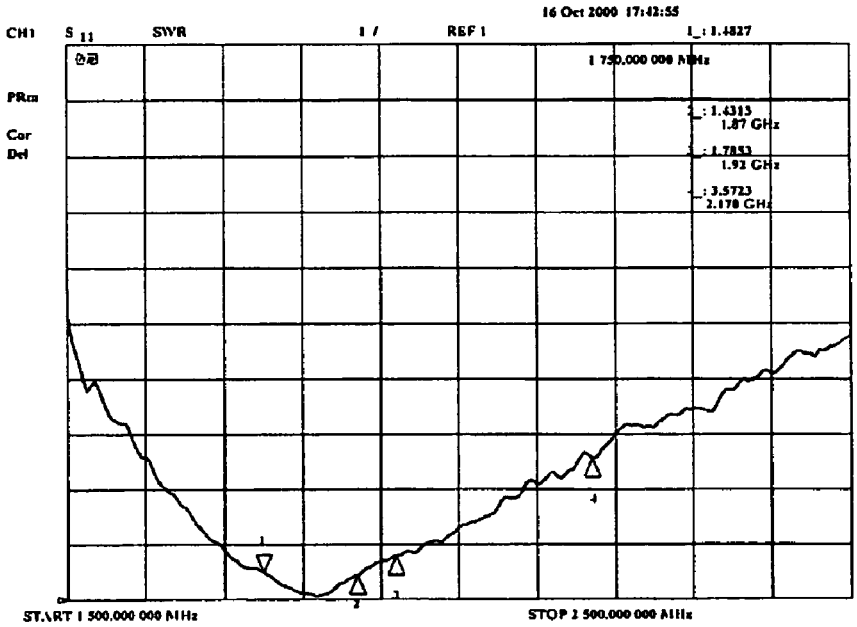
FIG.2 (Prior Art)
FIG. 2 shows frequency characteristics of the general mobile communication patch antenna.
Figure 7:
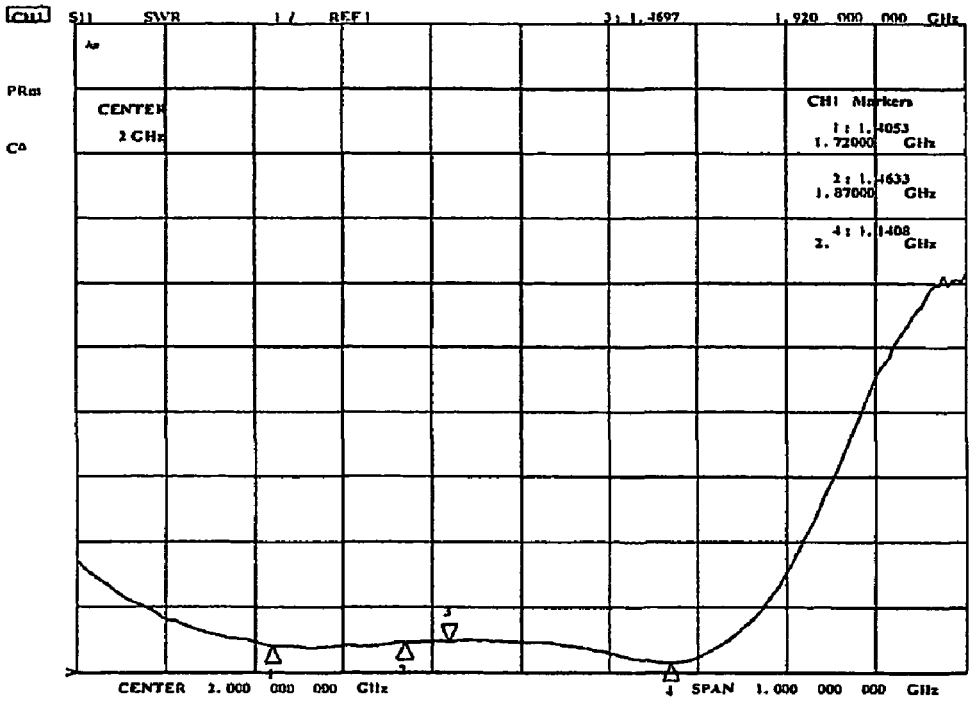
FIG. 7 shows frequency characteristics of the mobile communication wide-band antenna of FIG. 3.

For example, the conventional antenna as shown in FIG. 2 only supports the PCS frequency bands, but when referring to the frequency characteristics of the mobile communication wide-band antenna according to the first preferred embodiment as shown in FIG. 7, the mobile communication wide-band antenna according to the present invention can support the PCS and IMT-2000 frequency bands.

Next, a configuration and operation of the operating state display 30 will be described in detail.

The operating state display 30 comprises a helical antenna 31 for receiving the radio waves radiated by the radio wave radiator 20 and outputting corresponding RF signals and DC voltages; and a power detector 33 for receiving the RF signals and the DC voltages and displaying the same to distinguish operating states of the radio wave radiator 20.

The helical antenna 31 is installed around the radiation element 21, is supported by a ground surface 25, and has a length of "h3" and a diameter of 2 mm.

Figure 6:
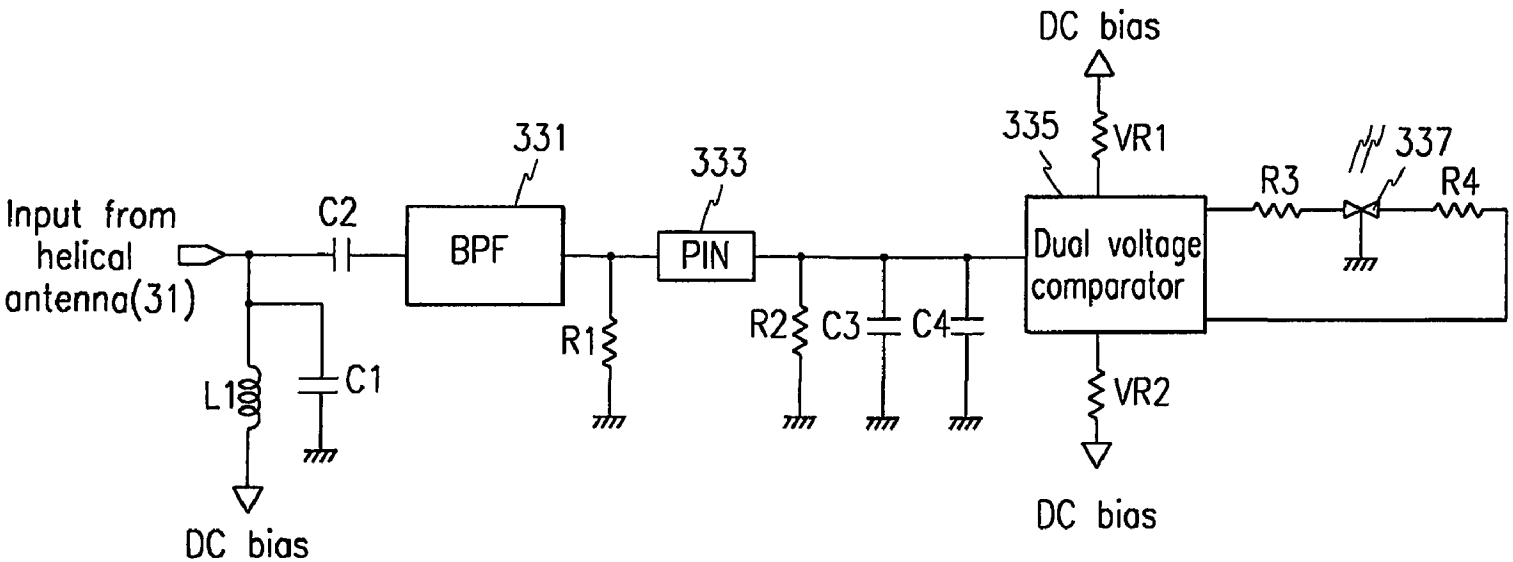
FIG. 6 shows a detailed circuit diagram of a power detector 33 in the mobile communication wide-band antenna of FIG. 3.

FIG. 6 shows a detailed circuit diagram of a power detector 33 in the mobile communication wide-band antenna of FIG. 3.

As shown, the power detector 33 comprises a band pass filter (BPF) 331 for receiving the RF signals and the DC voltages from the helical antenna 31 via a second capacitor C2 and passing signals of predetermined bands; a PIN diode 333 for adjusting magnitudes of the signals output by the BPF 331; a dual voltage comparator 335 for receiving the signals from the PIN diode 333, comparing a first reference voltage with a second reference voltage and outputting a result voltage; a three color light emitting diode 337 for emitting three color beams according to the voltage output by the dual voltage comparator 335; a first inductor L1 connected between an output terminal of the helical antenna 31 and the DC bias; a first capacitor C1 connected between the output terminal of the helical antenna 31 and the ground; a first resistor R1 connected between an output terminal of the BPF 331 and the ground; a second resistor R2, a third capacitor. C3 and a fourth capacitor C4 each of which is connected between an output terminal of the PIN diode 333 and the ground in parallel; a second capacitor C2; a first variable resistor VR1 having one terminal connected to the dual voltage comparator 335 and another terminal connected to the DC bias; a second variable resistor VR2 having one terminal connected to the dual voltage comparator 335 and another terminal connected to the DC bias; a third resistor R3 connected between the dual voltage comparator 335 and the three color light emitting diode 337; and a fourth resistor R4 connected between the dual voltage comparator 335 and the three color light emitting diode 337.

When the RF signals and the DC voltages are transmitted by the helical antenna 31 and passed through the first inductor L1 and the first capacitor C1, only the DC components are transmitted to the BPF 331. In this instance, the second capacitor C2 passes RF signals and not the DC components.

The BPF 331 passes the RF signals corresponding to the band of the signals transmitted by the wide-band antenna according to the present invention, and the signals output by the BPF 331 are converted into corresponding minute voltages by the PIN diode 333 and are then input to the dual voltage comparator 335. Here, the first and second resistors R1 and R2 and the third and fourth capacitors C3 and C4 only pass RF signals, and particularly, the first and second resistors R1 and R2 are used for impedance matching of the PIN diode 333. Since the diodes of Ge and Si used for electronic circuits for processing low frequency signals are not appropriate for processing the RF signals, chemical diodes such as the PIN diode 333 are used.

The dual voltage comparator 335 compares the voltage output by the PIN diode 333 respectively with the first reference voltage set by the first variable resistor VR1 and the second reference voltage set by the second variable resistor VR2, and outputs the voltages according to the comparison results.

The three color light emitting diode 337 emits the beams set according to the voltages output by the dual voltage comparator 335.

For example, in the case the first reference voltage is set to be greater than the second reference voltage and the voltage output by the PIN diode 333 is greater than the first reference voltage, the dual voltage comparator 335 outputs a corresponding voltage and the three color light emitting diode 337 generates the green corresponding to the output voltage so as to indicate that the radio wave radiator 20 is normally working and the output is very great.

In the case the voltage output by the PIN diode 333 is less than the second reference voltage, the dual voltage comparator 335 outputs a corresponding voltage and the three color light emitting diode 337 generates the red corresponding to the output voltage so as to indicate that the radio wave radiator 20 is not normally working.

Also, in the case the voltage output by the PIN diode 333 is less than the first reference voltage and greater than the second reference voltage, the dual voltage comparator 335 outputs a corresponding voltage and the three color light emitting diode 337 generates the color including the green and the red so as to indicate that the radio wave radiator 20 is normally working and the output is appropriate.

In the case the radio wave radiator 20 is not working and accordingly the PIN diode 333 generates no voltage, the three color light emitting diode 337 does not generate beams since the dual voltage comparator 335 generates no output.

Therefore, by installing the three color light emitting diode 337, the user of the mobile communication wide-band antenna can easily check with the naked eye the operating state of the antenna without approaching the antenna.

The first and second reference voltages set to the dual voltage comparator 335 are set by inputting various RF signals and the DC voltages to input terminals of the power detector 33, watching the color emitted by the three color light emitting diode 337, and adjusting the resistances of the first and second variable resistors VR1 and VR2.

Figure 8:
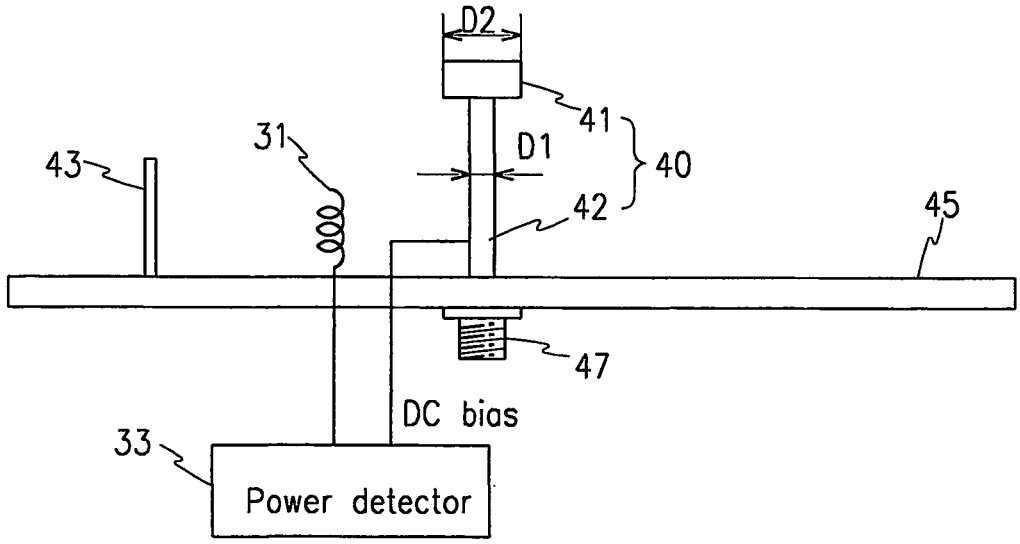
FIG. 8 shows a brief diagram of a mobile communication wide-band antenna according to a second preferred embodiment of the present invention.

FIG. 8 shows a brief diagram of a mobile communication wide-band antenna according to a second preferred embodiment of the present invention.

The antenna of FIG. 4 radiates in a semi-plane manner, and the antenna of FIG. 8 includes a monopole radiation element 40 that radiates in all directions.

The monopole radiation element 40 comprises a fixation antenna 42 supported on a ground surface 45; and a rod antenna 41 that penetrates the fixation antenna 42 and is flexibly installed from the ground surface 45. The fixation antenna 42 is connected to the ground surface 45 via a connector 47, and the RF signals and the power are supplied to the monopole radiation element 40 via the connector 47.

The fixation antenna 42 and the rod antenna 41 are cylindrical, and the diameter of the rod antenna 41 is greater than that of the fixation antenna 42.

The whole length of the monopole radiation antenna 40 for the common use of the PCS and the IMT-2000 services, that is, the sum of the lengths of the fixation antenna 42 and the rod antenna 41 is set to be about $\lambda/4$ in the case of setting the wavelength $\lambda$ of the reference frequency 1.840 GHz as the reference, and the ratio of the diameter D1 of the fixation antenna 42 and that D2 of the rod antenna 41 is set to be about 8:11.

Experimentally, the whole length of the monopole radiation element 40 is 32 mm, the diameter D1 of the fixation antenna 42 is 8 mm, and the diameter D2 of the rod antenna 41 is 11 mm. In this instance, the impedance matching is performed by adjusting the gap between an impedance matching stub 43 and the monopole radiation element 40. The length of the impedance matching stub 43 is set to be about $\lambda/8$ in the case of setting the wavelength $\lambda$ of the above-noted reference frequency as the reference, in detail it is set as 19 to 21 mm. According to the above-described setting, a frequency bandwidth of about 420 MHz is obtained.

In the same manner of the first preferred embodiment, a helical antenna 31 for receiving the radio waves radiated by the radiation element 40 is installed on the ground surface 45 near the monopole radiation element 40.

Therefore, in the same manner of the first preferred embodiment, the radio waves received by the helical antenna 31 are input to the power detector 33, and the power detector 33 displays the operation state of the radiation element 40 to be distinguished by the user's naked eye according to the input radio waves.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A mobile communication wide band antenna comprising:

a radio wave radiator for receiving transmission signals and power and radiating radio waves corresponding to the transmission signals, wherein the radio wave radiator comprises:

a ground surface for functioning as ground;

a radiation element supported by the ground surface to have a first gap from the ground surface and radiating the radio waves; and a microstrip feeder supported by the ground surface, having a second gap and a third gap from the ground surface, for receiving the transmission signals and the power and having an electromagnetic coupling with the radiation element, the third gap being located between the ground surface and the radiation element; and an operating state display for receiving the radio waves radiated by the radio wave radiator and displaying operating states of the radio wave radiator according to the received radio waves.

2. The antenna of claim 1, wherein the microstrip feeder is formed to be L-shaped.

3. The antenna of claim 1, wherein the microstrip feeder is formed to have an impedance matching with an external device for receiving the transmission signals.

4. The antenna of claim 3, wherein the matching impedance is 50 Ω in the case of the impedance matching.

5. The antenna of claim 4, wherein the matching impedance of 50 Ω is established according to the second gap between the width of the microstrip feeder and the ground surface.

6. The antenna of claim 1, wherein the dimensions of the radiation element, and the first, second and third gaps are determined according to a central frequency of the total frequency bands including the frequency bands of PCS and IMT-2000 services.

7. The antenna of claim 6, wherein in the case the central frequency is a frequency λ that belongs to a receipt frequency band of the PCS service, the dimensions (L×W1) of the radiation element are set to be about λ/2, the first gap H is about λ/8, and the third gap is about 0.7 times that of the first gap H.

8. The antenna of claim 1, wherein the operating state display comprises:

a radio wave receiving element, located around the radiation element of the radio wave radiator and supported by the ground surface, for receiving the radio waves radiated by the radiation element and outputting corresponding signals and voltages; and a power detector for receiving the signals and the voltages output by the radio wave receiving element and displaying the operating states of the radio wave radiator to be distinguished.

9. The antenna of claim 8, wherein the radio wave receiving element is a helical antenna.

10. The antenna of claim 8, wherein the power detector comprises:

a band pass filter (BPF) for receiving the transmission signals and the voltages from the radio wave receiving element and passing signals of a predetermined band;

a PIN diode for adjusting an amount of the signals output by the BPF and outputting result signals;

a dual voltage comparator for receiving the signals output by the PIN diode and comparing the received signals with previously set first and second reference voltages and outputting result voltages; and a three color light emitting diode for emitting three colors according to the voltage output by the dual voltage comparator.

11. The antenna of claim 10, wherein the antenna further comprises a first variable resistor for adjusting the first reference voltage and a second variable resistor for adjusting the second reference voltage respectively set to the dual voltage comparator.

12. A mobile communication wide band antenna comprising:

a ground surface for functioning as ground;

a monopole radiation element, supported on the ground surface, for radiating radio waves in all directions;

a connector for supplying transmission signals and power to the monopole radiation element, the connector being a portion where the monopole radiation element penetrates the ground surface and is extended;

an impedance matching stub supported by the ground surface and provided to the monopole radiation element with a predetermined gap so as to perform impedance matching;

a radio wave receiving element provided near the monopole radiation element, supported by the ground surface, for receiving the radio waves radiated by the monopole radiation element and outputting corresponding signals and voltages; and a power detector for receiving the signals and the voltages output by the radio wave receiving element and displaying the operating states of the monopole radiation element to be distinguished.

13. The antenna of claim 12, wherein the radio wave receiving element is a helical antenna.

14. The antenna of claim 12, wherein the monopole radiation element comprises a fixation antenna supported on the ground surface and a rod antenna that penetrates the fixation antenna and is flexibly installed from the ground surface, and the fixation antenna and the rod antenna are cylindrical, and a diameter of the rod antenna is greater than that of the fixation antenna.

15. The antenna of claim 14, wherein the dimensions of the monopole radiation element and the length of the impedance matching stub are determined according to a central frequency of the total frequency bands including the frequency bands of PCS and IMT-2000 services.

16. The antenna of claim 15, wherein in the case the central frequency is a frequency λ that belongs to a receipt frequency band of the PCS service, the whole length of the monopole radiation element adding the lengths of the fixation antenna and the rod antenna is set to be about λ/4, and the ratio of the diameter D1 of the fixation antenna and that D2 of the rod antenna is set to be about 8:11, and the length of the impedance matching stub is set to be about λ/8.

* * * * *

UNITED STATES PATENT AND TRADEMARK OFFICE

CERTIFICATE OF CORRECTION

PATENT NO. : 7,002,520 B2
APPLICATION NO. : 10/474532
DATED : February 21, 2006
INVENTOR(S) : Bae It is certified that error appears in the above-identified patent and that said Letters Patent is hereby corrected as shown below:

Title page,
Item (73), Assignee, "Guangju" should read --Gwangju--.

Signed and Sealed this

Twenty-second Day of August, 2006

JON W. DUDAS
*Director of the United States Patent and Trademark Office*